US010000839B2

(12) United States Patent
Sordelet

(10) Patent No.: US 10,000,839 B2
(45) Date of Patent: Jun. 19, 2018

(54) THERMAL SPRAY COMPOSITION AND COMPONENT MADE THEREWITH

(71) Applicant: Caterpillar Inc., Peoria, IL (US)

(72) Inventor: Daniel Sordelet, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 226 days.

(21) Appl. No.: 15/162,767

(22) Filed: May 24, 2016

(65) Prior Publication Data

US 2017/0342538 A1 Nov. 30, 2017

(51) Int. Cl.

| | |
|---|---|
| ***B32B 15/00*** | (2006.01) |
| ***C23C 4/08*** | (2016.01) |
| ***C23C 4/126*** | (2016.01) |
| ***C23C 4/129*** | (2016.01) |
| ***C23C 4/131*** | (2016.01) |
| ***C23C 4/134*** | (2016.01) |
| ***C22C 38/16*** | (2006.01) |
| ***C22C 38/06*** | (2006.01) |
| ***C22C 38/04*** | (2006.01) |
| ***C22C 38/02*** | (2006.01) |

(52) U.S. Cl.

CPC ..... *C23C 4/08* (2013.01); *C22C 38/02* (2013.01); *C22C 38/04* (2013.01); *C22C 38/06* (2013.01); *C22C 38/16* (2013.01); *C23C 4/126* (2016.01); *C23C 4/129* (2016.01); *C23C 4/131* (2016.01); *C23C 4/134* (2016.01)

(58) Field of Classification Search

CPC C23C 4/08; C23C 4/126; C23C 4/129; C23C 4/131; C23C 4/134; C22C 38/02; C22C 38/16; C22C 38/06; C22C 38/04

USPC ..... 428/681

See application file for complete search history.

(56) References Cited

U.S. PATENT DOCUMENTS

| | | | |
|---|---|---|---|
| 3,278,348 | A | 10/1966 | Foster et al. |
| 5,695,825 | A | 12/1997 | Scruggs |
| 7,482,065 | B2 | 1/2009 | Branagan |
| 9,140,389 | B2 | 9/2015 | Moreira De Carvalho et al. |
| 2013/0052361 | A1* | 2/2013 | Croopnick ..... C22C 45/02 427/456 |
| 2014/0009872 | A1* | 1/2014 | Prest ..... C23C 4/18 361/679.01 |
| 2015/0118516 | A1 | 4/2015 | Boileau et al. |
| 2015/0275341 | A1 | 10/2015 | Cheney et al. |

FOREIGN PATENT DOCUMENTS

| | | |
|---|---|---|
| CN | 105154792 | 12/2015 |

* cited by examiner

*Primary Examiner* — William K Cheung

(57) ABSTRACT

Thermal spray coating compositions, methods of using thermal spray coating compositions, and remanufactured components are disclosed herein. A thermal spray coating composition can include about 7% to about 9% by weight aluminum, about 5% to about 7% by weight silicon, about 1% to about 3% by weight manganese, about 1% to about 14% by weight copper, with a remaining balance of iron. The thermal spray coating composition can include about 2% to about 12% by weight copper.

14 Claims, No Drawings

THERMAL SPRAY COMPOSITION AND COMPONENT MADE THEREWITH

TECHNICAL FIELD

The present disclosure relates to thermal spray coating compositions, and more specifically, to thermal spray coating compositions for remanufactured components.

BACKGROUND

Manufacturing new components can be extremely expensive, accordingly, engineers are constantly seeking ways to refurbish or remanufacture used components to match technical and dimensional specifications for the component as new. For instance, in the engine industry there is a continuous effort to find new and more economical ways to remanufacture components, such as engine blocks and engine heads. Remanufacturing metallic components often requires adding material to the used body to build up a surface that no longer satisfies a dimensional specification for the component. For instance, in the case of an engine block, the distance between the head face and a centerline of a crank shaft support bore may have slightly decreased over the life of the used block. Therefore, in order to remanufacture the engine block, the head face needs to have material added, and then the treated component often needs to be reshaped by removing some of the added material to return all dimensions to specification.

Many different techniques for remanufacturing a component exist, however, the newly added material often also must exhibit characteristics that match or exceed the metallic material of the original component. For instance, in the case of an engine head or engine block, the added material must successfully undergo many cycles of being heated from ambient temperature to combustion temperatures on the order of about 700° C., be exposed to corrosive gases, and do so without degradation on par with the base metallic material, which may be steel or cast iron. Apart from these considerations, cost of the added material can be a constraint as well as the ability of the added material to be machined back into specification. Thus, finding a technique to add the material, and finding an appropriate metallic material for addition in a remanufacturing procedure while satisfying many different and often conflicting constraints, including cost, can be extremely elusive.

The present disclosure is directed toward one or more of the problems set forth above.

SUMMARY OF THE INVENTION

In one aspect, the present disclosure is related to a thermal spray coating composition comprising about 7% to about 9% by weight aluminum, about 5% to about 7% by weight silicon, about 1% to about 3% by weight manganese, about 1% to about 14% by weight copper, with a remaining balance of iron. In one embodiment, the copper content is about 2% to about 12% by weight. Specifically, for example, the copper can be about 2% by weight, about 6% by weight, or about 12% by weight.

The thermal spray coating composition can include about 8% aluminum by weight. The thermal spray coating composition can include about 6% silicon by weight silicon. The thermal spray coating composition can include about 2% manganese by weight.

The thermal spray coating composition can be used in one or more of the following processes: plasma spraying, detonation spraying, twin wire arc spraying, flame spraying, or high velocity oxy-fuel coating spraying. The thermal spray coating composition can be a wire, for example, a cored wire. The thermal spray coating composition can be gas atomized powder.

In another aspect, the present disclosure relates to a method of remanufacturing a component including applying a thermal spray coating composition to a substrate, wherein the thermal spray coating composition comprises about 8% by weight aluminum, about 6% by weight silicon, about 2% by weight manganese, about 1% to about 14% by weight copper, with a remaining balance of iron; and cooling the thermal spray coating composition rapidly. In one embodiment, the thermal spray coating composition includes about 2% to about 12% by weight copper.

The method can be applied by a process selected from the following: plasma spraying, detonation spraying, twin wire arc spraying, flame spraying, or high velocity oxy-fuel coating spraying.

The thermal spray coating composition can be a wire, for example, a cored wire. The thermal spray coating composition can be gas atomized powder.

In still another aspect, the present disclosure relates to a remanufactured component including a substrate and a thermal spray coating composition including about 8% by weight aluminum, about 6% by weight silicon, about 2% by weight manganese, about 2% to about 12% copper, with a remaining balance of iron. The thermal spray coating composition can be a wire.

DETAILED DESCRIPTION

This disclosure relates to components, compositions, and methods for manufacturing machine components via a thermal spray coating process. Machines, such as track type tractors or excavators, include components that are subject to wear. Compositions have been developed to repair or restore those worn components. The disclosed compositions can be applied to a wide range of components that receive a layer of material to provide a new surface.

Many different components, particularly engine components, can be remanufactured and returned to service for a second useful life that may even exceed the useful life of a newly manufacture component. Parts that may be subject to remanufacture include, but are not limited to, engine heads, engine blocks, shafts, oil coolers, pump/turbo/engine housings, covers, intake/exhaust fittings, crankshafts, wheel spindles, rail car axles, brake anchors, and many others.

A used component will have a shape resulting from use, which may be attributed to at least one of wear and/or degradation, and removal of additional material from the component to properly prepare a surface for remanufacturing. For instance, it might be desirable to remove some of the original metallic material so that the resulting coating, after being milled, has some minimum thickness. In any event, the shape of the body will include at least one dimension that does not match the dimensional specification for the component.

The disclosed composition can be applied using a thermal spray process. Specifically, the thermal spray process can include a process selected from the following: plasma spraying, detonation spraying, twin wire arc spraying, flame spraying, or high velocity oxy-fuel coating spraying.

The thermal spray coating composition can include about 7% to about 9% by weight aluminum, about 5% to about 7% by weight silicon, about 1% to about 3% by weight manganese, about 1% to about 14% by weight copper, with a remaining balance of iron. In one embodiment, the thermal spray coating composition can include about 2% to about 12% by weight copper. For example, the thermal spray coating composition can include about 2% copper by weight, about 6% copper by weight, or about 12% copper by weight.

The thermal spray coating composition can include about 8% by weight aluminum. The thermal spray coating composition can include about 6% by weight silicon. The thermal spray coating composition can include about 2% by weight manganese.

In one embodiment the thermal spray coating composition can be supplied during the thermal spray process as a wire, for example, as a cored wire. In another embodiment, the thermal spray coating composition can be gas atomized powder.

In another aspect, the present disclosure relates to a method of remanufacturing a component including applying a thermal spray coating composition to a substrate and cooling the thermal spray coating composition rapidly. The thermal spray coating composition can include about 8% by weight aluminum, about 6% by weight silicon, about 2% by weight manganese, about 1% to about 14% by weight copper, with a remaining balance of iron. In one embodiment, the thermal spray coating composition can include about 2% to about 12% by weight copper. For example, the thermal spray coating composition can include about 2% copper by weight, about 6% copper by weight, or about 12% copper by weight.

The thermal spray coating composition can include about 8% by weight aluminum. The thermal spray coating composition can include about 6% by weight silicon. The thermal spray coating composition can include about 2% by weight manganese.

The thermal spray coating composition can be applied by a process selected from the following: plasma spraying, detonation spraying, twin wire arc spraying, flame spraying, or high velocity oxy-fuel coating spraying.

The thermal spray coating composition can be supplied during the thermal spray process as a wire, for example, a cored wire. The thermal spray coating composition can also be supplied during the thermal spray process as gas atomized powder.

After the thermal spray coating composition is applied, the component can be subjected to a heat treatment process. For example, the component can be heated to about 800° Celsius (C) for 24 hours.

The term "about" means a number rounded to the nearest significant digit. Thus, 749° C. is about 700° C., but 760° C. is not about 700° C.

EXAMPLE

The following example is for illustrative purposes only. The following compositions were deposited onto a substrate using a thermal spray process. Each of the compositions was machined using the same tools and the surface roughness was measured. Surface roughness is highly dependent upon the particular technique and machine used. It is believed that surface roughness may correlate to machinability of the composition.

| Element | Composition 1 | Composition 2 | Composition 3 | Composition 4 |
|---|---|---|---|---|
| Aluminum | 8% | 8% | 8% | 8% |
| Silicon | 6% | 6% | 6% | 6% |
| Manganese | 0% | 2% | 2% | 2% |
| Copper | 0% | 2% | 6% | 12% |
| Iron | Balance | Balance | Balance | Balance |

The surface roughness of the composition 1 was 2.4 microns, composition 2 was 1.6 microns, composition 3 was 1.0 microns, and composition 4 was about 0.7 microns. A lower surface roughness generally correlates to a higher machinability. Accordingly, the increased copper concentrations showed increased machinability.

It is believed that adding face-centered cubic (fcc) transition metal elements, such as copper, that are insoluble in a body-centered cubic (bcc) iron matrix increases the machinability of the composition due to the uniform distribution of the fcc crystal structure phase. Moreover, it is believed that the rapid solidification that occurs during thermal spray deposition unexpectedly aided in achieving a very uniform distribution of copper within the iron matrix. In other words, it is believed that the molten droplets formed during thermal spraying solidified so quickly upon impact that the insoluble copper does not have time to segregate to their thermodynamically-stable condition as coarser, separate phases.

INDUSTRIAL APPLICABILITY

The present disclosure finds potential applicability in any remanufacture strategy where there is a desire for at least one of reducing cost of the coating material or improving efficiency with regard to the application and machining of the coating. The present disclosure finds specific application in substituting the disclosed thermal spray coating composition of the present disclosure in place of the material used in the past to remanufacture components.

The thermal spray coating composition of the present disclosure can be applied to a new part to increase wear and corrosion resistance or to a used part to bring the used part into specification for reuse. The used part may have a wear area that requires additional material, such as the disclosed thermal spray coating composition. The used part, or a remanufactured component, can include a substrate and a thermal spray coating composition including about 8% by weight aluminum, about 6% by weight silicon, about 2% by weight manganese, about 2% to about 12% copper, with a remaining balance of iron. The substrate is usually the original material that has worn away during use of the component. The thermal spray coating composition provides the remanufactured component with the material to restore the worn area.

For example, the thermal spray coating composition can be applied to a worn component to return the component to its original dimensions. The thermal spray coating composition can be applied repeatedly to build up the wear area, depending on the level of wear. The thermal spray coating composition, therefore, can restore the remanufactured component to the same dimensions as the original component.

It will be apparent to those skilled in the art that various modification and variations can be made to the disclosed composition, method, and remanufactured component. Other embodiments will be apparent to those skilled in the art from consideration of the specification and practice of the disclosed composition. It is intended that the specification and example be considered as exemplary only, with a true scope being indicated by the following claims and their equivalents.

What is claimed is:

1. A thermal spray coating composition comprising about 7% to about 9% by weight aluminum, about 5% to about 7% by weight silicon, about 1% to about 3% by weight manganese, about 1% to about 14% by weight copper, with a remaining balance of iron.

2. The thermal spray coating composition of claim 1, wherein the copper is about 2% to about 12% by weight.

3. The thermal spray coating composition of claim 1, wherein the aluminum is about 8% by weight.

4. The thermal spray coating composition of claim 1, wherein the silicon is about 6% by weight silicon.

5. The thermal spray coating composition of claim 1, wherein the manganese is about 2% by weight.

6. The thermal spray coating composition of claim 1, wherein the copper is about 2% by weight.

7. The thermal spray coating composition of claim 1, wherein the copper is about 6% by weight.

8. The thermal spray coating composition of claim 1, wherein the copper is about 12% by weight.

9. The thermal spray coating composition of claim 1, wherein the thermal spray coating can be used in one or more of the following processes: plasma spraying, detonation spraying, twin wire arc spraying, flame spraying, or high velocity oxy-fuel coating spraying.

10. The thermal spray coating composition of claim 1, wherein the thermal spray coating composition is a wire.

11. The thermal spray coating composition of claim 9, wherein the wire is a cored wire.

12. The thermal spray coating composition of claim 1, wherein the thermal spray coating composition is gas atomized powder.

13. A remanufactured component comprising a substrate and a thermal spray coating composition comprising about 8% by weight aluminum, about 6% by weight silicon, about 2% by weight manganese, about 2% to about 12% copper, with a remaining balance of iron.

14. The remanufactured component of claim 13, wherein the thermal spray coating composition is a wire.

* * * * *